United States Patent [19]

Pierce

[11] 4,120,172

[45] Oct. 17, 1978

[54] HEAT TRANSPORT SYSTEM

[75] Inventor: Bill L. Pierce, Pittsburgh, Pa.

[73] Assignee: The United States of America as represented by the United States Department of Energy, Washington, D.C.

[21] Appl. No.: 794,296

[22] Filed: May 5, 1977

[51] Int. Cl.[2] ..... F25B 1/00; F25D 15/00

[52] U.S. Cl. ..... 62/115; 62/119; 62/467 R

[58] Field of Search ..... 62/115, 119, 514, 467 R

[56] References Cited

U.S. PATENT DOCUMENTS

| | | | |
|---|---|---|---|
| 1,887,687 | 11/1932 | Killeffer | 62/119 |
| 3,473,344 | 10/1969 | Brandon | 62/115 |
| 3,521,461 | 7/1970 | Granryd | 62/115 |
| 3,645,111 | 2/1972 | Williamitis | 62/115 |
| 3,677,026 | 7/1972 | Granryd | 62/115 |
| 3,677,027 | 7/1972 | Granryd | 62/115 |

*Primary Examiner*—Lloyd L. King

*Attorney, Agent, or Firm*—Dean E. Carlson; Frank H. Jackson

[57] ABSTRACT

A heat transport system of small size which can be operated in any orientation consists of a coolant loop containing a vaporizable liquid as working fluid and includes in series a vaporizer, a condenser and two one-way valves and a pressurizer connected to the loop between the two valves. The pressurizer may be divided into two chambers by a flexible diaphragm, an inert gas in one chamber acting as a pneumatic spring for the system.

4 Claims, 2 Drawing Figures

HEAT TRANSPORT SYSTEM

CONTRACTUAL ORIGIN OF THE INVENTION

The invention described herein was made in the course of, or under, a contract with the UNITED STATES ENERGY RESEARCH AND DEVELOPMENT ADMINISTRATION.

BACKGROUND OF THE INVENTION

This invention relates to a heat transport system. In more detail, the invention relates to a small flexible heat transport system capable of operation in any orientation which uses the latent heat of a working fluid rather than mechanical energy. In still more detail, the invention relates to a heat rejection system which has high reliability, uses no mechanical energy, has a small volume and low weight, may be operated in any orientation, has a long life and thus is suitable for use in a nuclear-powered artificial heart.

In many applications where component cooling is required, it may be inconvenient or undesirable thermally to dissipate the heat via a heat sink or radiator located immediately adjacent the component. For example, to dissipate heat from a high power device containing other temperature sensitive components will require that the heat be conducted from the module to a heat sink exterior to the module. In addition, in a nuclear-powered artificial heart, a small flexible heat rejection system capable of operation in any orientation is required to carry the waste heat from the heat source to the blood pumping unit. Heat rejection systems of this type may also be useful for reclaiming waste heat.

Where small volume and low weight are imperative, heat transport systems employing pumps and compressors are impractical. While the high effective thermal conductivity of heat pipes enables the transfer of heat at high efficiency over considerable distances, heat pipes are not useful where small volume and flexible construction of the pipe are both required.

SUMMARY OF THE INVENTION

The heat transport system of the present invention comprises a coolant loop containing a vaporizable liquid as working fluid and includes in series a vaporizer, a condenser downstream of the vaporizer, a first check valve downstream of the condenser set to permit flow only from the condenser through the check valve and a second check valve between the first check valve and the vaporizer set to permit flow only through the check valve to the vaporizer. A pressurizer vessel which may have a diaphragm extending thereacross is connected to the coolant loop so that one of the chambers in the pressurizer vessel contains vaporizable liquid, the other chamber containing a fixed mass of an inert gas.

DETAILED DESCRIPTION OF THE INVENTION

Figure 1:
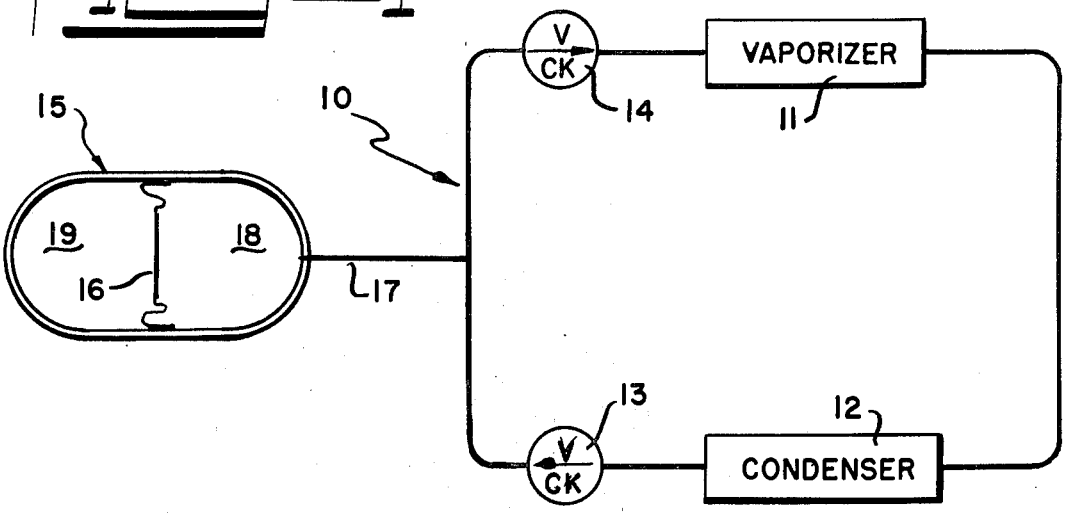
FIG. 1 is a schematic drawing of a heat transport system according to the present invention.

As shown schematically, a coolant loop 10 containing a vaporizable liquid as working fluid includes in series a vaporizer 11, a condenser 12 downstream of the vaporizer, a first check valve 13 downstream of the condenser set to permit flow only from the condenser through the check valve and a second check valve 14 between the first check valve 13 and the vaporizer 11 set to permit flow only through the check valve 14 to the vaporizer 11. Fluidic diodes may be used rather than the check valves 13 and 14. In addition, a pressurizer vessel 15 having a flexible diaphragm 16 extending thereacross is connected by a line 17 to the coolant loop 10 between the two check valves so that one chamber 18 of the pressurizer vessel 15 contains vaporizable liquid. The other chamber 19 contains a constant mass of an inert gas which thus constitutes a pneumatic spring.

The diaphragm 16 separates the inert gas from the working fluid as is necessary in any application in which operation of the system must be independent of orientation. For other applications where gravity can be relied on, the diaphragm may not be necessary.

The effects of power level, pressure level, orientation, pressurizer volume and sink temperatures on thermal performance were evaluated. Three modes of operation were identified. The first mode is the sub-cooled boiling mode in which the heat supplied to the vaporizer begins to vaporize the liquid, forcing liquid present in condenser 12 through the first check valve 13 into the pressurizer. This continues until the vapor-liquid interface reaches a point in the condenser so that sufficient condenser area is available to condense the vapor at the rate it is being produced in the vaporizer. The quasi-steady state condition exists until most of the liquid in the vaporizer has been vaporized. Then the rate of condensation is greater than the rate of vaporization and the pressure in the loop between the check valves drops. Liquid is then forced through check valve 14 from the pressurizer through the vaporizer and into the condenser. This mode can be characterized primarily by the fact that the temperature of the loop between the vaporizer and condenser periodically drops below the fluid saturation temperature, indicating that sub-cooled liquid is drawn through the vaporizer into the condenser.

The second mode is the nucleate boiling mode. In this mode, the temperature of the loop between the vaporizer and condenser is essentially constant at the fluid saturation temperature. The third mode is the film boiling mode, in which the temperature of the loop between the vaporizer and condenser is greater than the fluid saturation temperature and is quite sensitive to power level.

The general thermal performance of the test loop with a fixed power level is as follows. With the coolant water temperature into the condenser well below (~20° F.) the methanol working fluid saturation temperature, the subcooled boiling mode is observed. When the coolant temperature is increased to within 7° to 10° F. of the saturation temperature, the nucleate boiling mode is observed. The film boiling mode occurs upon further increases in coolant temperature. With fixed coolant temperature, increases in power level produce first a transition from sub-cooled to nucleate boiling and then to film boiling.

Heat is thus transported from the vaporizer to the condenser without using a mechanically pumped loop. Since the thermal pump heat transport system uses the latent heat of the fluid, relatively low flow rates are required when compared to a pumped loop which uses sensible heat and relatively small temperature differences are required to transport heat because the boiling and condensing film heat transfer coefficients are high.

According to one specific embodiment of the invention, the vaporizer and condenser would consist of coils of 50 mil tubing surrounding the heat source and heat sink, respectively. The pressurizer is about 1 cubic inch in size. Materials of construction depend on the working fluid; copper is satisfactory where acetone, methanol or water is the working fluid. The diaphragm may be a metal bellows or "silastic" membrane. The pressure is dependent on the desired operating temperature and the working fluid. The inert gas may be argon, for instance. The system in one application will remove 20–30 watts of heat in a temperature range of 100°–130° F.

While a wide variety of working fluids are potentially useful, several have been identified as having characteristics making them useful in an artificial heart system. These characteristics are: (1) the saturation temperature of the fluid should be $> 115°$ F. but $\leqq 120°$ F. at approximately one atmosphere, (2) the fluid's toxicity and flammability characteristics should permit ease of handling, (3) the working fluid should be non-corrosive in the environment of use. Useful working fluids include trichlorotrifluoroethane, propionaldehyde, acetone, dichloroethylene, methanol, n-propylamine, cyclopentane, neohexane, methanol-1, 1 dichloroethane, azeotrope, methanol-hexane (N) azeotrope, methanol-benzene azeotrope, acetone-diethylamine azeotrope, and water.

In an initial proof of principle test, water was used as working fluid. The system performed satisfactorily whether the vaporizer was above, below or at the same elevation as the condenser and the temperature variation of the vaporizer was approximately 7° F.

Using methanol as working fluid, the above-described modes of operation were noted. A pressurizer in which the volume could be varied was used in these tests; no diaphragm was employed. In many of these tests, air was used as pressurizer gas. In actual operation, an inert gas such as argon would be preferable. In the nucleate boiling mode, the pressurizer volume was varied from infinity (open to the atmosphere) down to 0.15 cubic inch with no detectable difference in thermal performance. A vertical standpipe was used as pressurizer and the force of gravity held the working fluid in the system when the pressurizer was open to the atmosphere. The fact that the pressurizer can be so small is an outstanding characteristics of this system. Additional testing was done using acetone as the working fluid instead of methanol. Because acetone has a lower boiling point than methanol, the operating temperature of the loop decreased by about 15° F. with the loop operating at atmospheric pressure. Acetone has a lower heat of vaporization than methanol and the resulting higher flow rate for a given power provided more positive actuation of the flow-actuated check valves.

The device could be operated, for example, using methanol as working fluid at atmospheric pressure to transport heat from a heat source at 155° F. to a heat sink at 140° F. or at 6 pounds per square inch absolute to transport heat from a heat source at 120° F. to a heat sink at 105° F. Using acetone as working fluid, the temperature would be 140° F. to 125° F. at atmospheric pressure and 120° F. to 105° F. at 8.5 pounds per square inch absolute.

Figure 2:
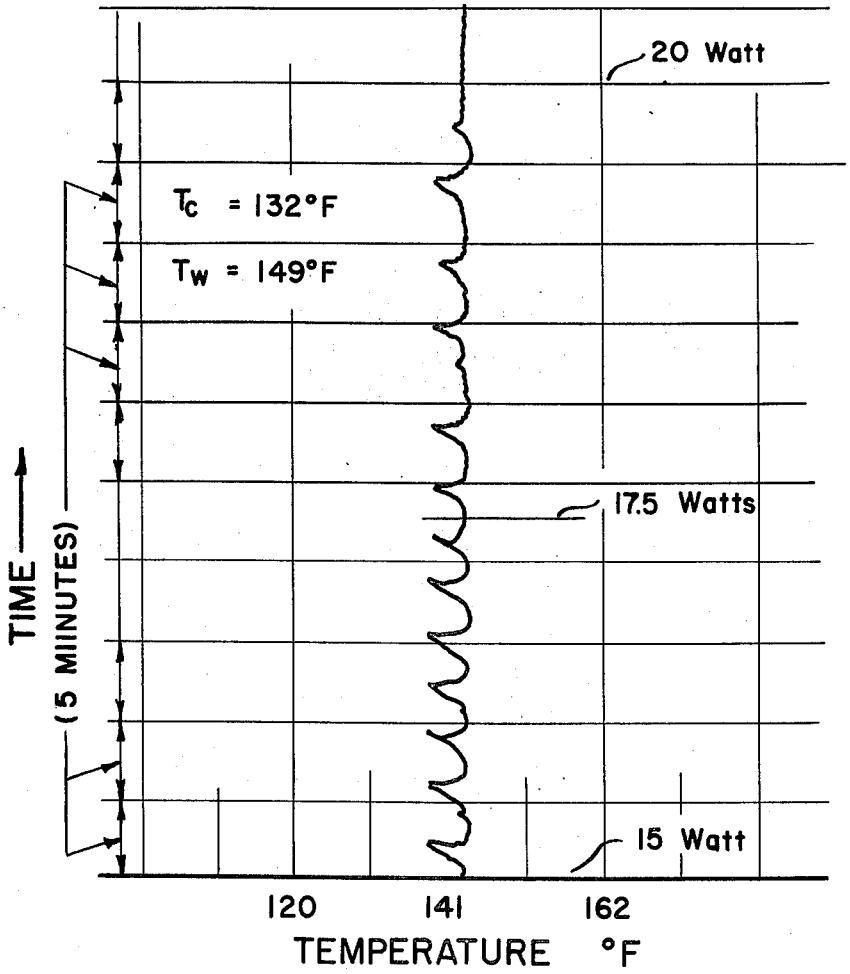
FIG. 2 is a thermocouple trace of the temperature of the working fluid in the coolant loop between the vaporizer and condenser as the power is increased.

These tests show clearly that the nucleate boiling mode is the most attractive operational mode and requires the least gas pressurizer volume, has the lowest temperature oscillation amplitude and is the least sensitive to power level. To obtain the nucleate boiling mode it is only necessary to coordinate the sink temperature, pressure level and pressurizer volume with the power level of the heat required to be dissipated. FIG. 2 is a trace of the temperature of the vaporizable fluid in the coolant loop about halfway between the vaporizer and the condenser. Methanol was employed as vaporizable fluid at atmospheric pressure.

The lower portion of the trace shows operation in the sub-cooling boiling mode. With fixed coolant temperature, increasing the power level produced the transition shown in FIG. 2. Here the initial power level is 15 watts and the sub-cooled spike appears approximately every 3 minutes. By increasing the power level to 17.5 watts, the sub-cooled spike period increased to about 5 minutes. Upon increasing the power level to 20 watts, the operational mode changed to the nucleate boiling mode. Variation in temperature in the nucleate boiling mode is on the order of ½ to 1° F. This feature was unexpected and is a great advantage of the method and system.

Nucleate boiling may also be had by increasing the coolant water temperature to within 7° to 10° F. of the methanol working fluid saturation temperature, producing the transition to nucleate boiling. Reducing the pressurizer gas volume down to about 0.3 cubic inch also forced a change in mode from sub-cooled boiling to nucleate boiling.

In the nucleate or sub-cooled boiling modes, the maximum fluid temperature is approximately equal to the fluid saturation temperature. The saturation temperature can be changed by either changing pressure level or by a change in the type of fluid.

That both check valves are necessary and are functioning was made evident when one check valve failed due to a chip being present therein. The system ceased to operate but was returned to operation when the check valve was replaced.

The embodiments of the invention in which an exclusive property or privilege is claimed are defined as follows:

1. A small flexible heat transport system comprising a coolant loop containing a vaporizable liquid as working fluid and including in series a vaporizer, a condenser and two valve means which permit the flow of fluid therethrough in one direction only and a pressurizer vessel containing a fixed mass of an inert gas connected to the loop between the two check valves whereby heat is transferred from the vaporizer to the condenser.

2. A heart transport system according to claim 1 which is capable of operation at any orientation wherein the pressurizer consists of a pressurizer vessel having a flexible diaphragm extending thereacross, there being a fixed mass of inert gas in the chamber of the pressurizer vessel remote from the coolant loop.

3. A heat transport system according to claim 2 in which the pressurizer vessel has a volume of 1 cubic inch.

4. A method of transporting heat from a heat source to a heat sink over a considerable distance comprising vaporizing a vaporizable liquid in the nucleate boiling mode with heat from the heat source, condensing the vapors thus produced by rejecting heat to the heat sink, returning the condensate to the vaporizer through two check valves in series to complete a coolant loop and driving the vaporizable liquid around the coolant loop with a pneumatic spring connected to the loop between the two check valves.

* * * * *